US009386904B2

(12) United States Patent
Fountain et al.

(10) Patent No.: US 9,386,904 B2
(45) Date of Patent: Jul. 12, 2016

(54) DISHWASHER WITH MOVABLE LIQUID CONDUIT

(75) Inventors: Jordan R. Fountain, St. Joseph, MI (US); Barry E. Tuller, Stevensville, MI (US); Rodney M. Welch, Eau Claire, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1314 days.

(21) Appl. No.: 12/949,055

(22) Filed: Nov. 18, 2010

(65) Prior Publication Data

US 2012/0125383 A1 May 24, 2012

(51) Int. Cl.
*A47L 15/42* (2006.01)
*A47L 15/00* (2006.01)

(52) U.S. Cl.
CPC ..... *A47L 15/421* (2013.01); *A47L 15/0084* (2013.01); *A47L 15/4214* (2013.01); *A47L 15/4217* (2013.01); *A47L 15/4212* (2013.01)

(58) Field of Classification Search
CPC ..... A47L 15/4214; A47L 15/421; A47L 15/0084; A47L 15/4217; A47L 15/4212
USPC ..... 134/56 D, 57 D, 58 D, 200, 201
See application file for complete search history.

(56) References Cited

U.S. PATENT DOCUMENTS

| | | | | | |
|---|---|---|---|---|---|
| 289,265 | A | * | 11/1883 | Hurly | 285/1 |
| 2,451,252 | A | * | 10/1948 | Stoeckly | 285/100 |
| 2,616,728 | A | * | 11/1952 | Pitt | 285/47 |
| 3,143,146 | A | * | 8/1964 | Kennedy | 138/107 |
| 3,492,030 | A | * | 1/1970 | Lund et al. | 285/300 |
| 3,574,361 | A | * | 4/1971 | Contreras et al. | 285/226 |
| 3,799,223 | A | * | 3/1974 | Feneziani | 141/388 |
| 5,145,215 | A | * | 9/1992 | Udell | 285/49 |
| 5,470,142 | A | | 11/1995 | Sargeant et al. | |
| 5,651,382 | A | | 7/1997 | Sargeant et al. | |
| 5,931,184 | A | * | 8/1999 | Armenia et al. | 137/312 |
| 6,491,049 | B1 | | 12/2002 | Tuller et al. | |
| 6,546,951 | B1 | * | 4/2003 | Armenia et al. | 137/312 |
| 6,997,195 | B2 | | 2/2006 | Durazzani et al. | |
| 7,077,166 | B2 | | 7/2006 | Heo et al. | |
| 7,219,678 | B2 | | 5/2007 | Nakano et al. | |
| 7,258,126 | B2 | | 8/2007 | Shinchi et al. | |
| 2003/0037809 | A1 | * | 2/2003 | Favaro | 134/58 D |
| 2003/0127855 | A1 | | 7/2003 | Heverly | |
| 2005/0224100 | A1 | | 10/2005 | Maunsell et al. | |

(Continued)

FOREIGN PATENT DOCUMENTS

| | | | | |
|---|---|---|---|---|
| CA | 2378123 | C | | 6/2004 |
| CN | 201370559 | Y | * | 12/2009 |
| DE | 7118517 | U | * | 1/1972 |

(Continued)

OTHER PUBLICATIONS

Machine translation of DE 202009004799 U1, dated Sep. 2010.*

(Continued)

*Primary Examiner* — Michael Barr
*Assistant Examiner* — Kevin G Lee

(57) ABSTRACT

A dishwasher includes a compartment in the form of a drawer or pull-out treating chamber slidably mounted in a chassis is provided with one or more liquid supply and draining conduits for supplying and draining liquid to and from the treating chamber.

12 Claims, 5 Drawing Sheets

(56) References Cited

U.S. PATENT DOCUMENTS

| | | | | |
|---|---|---|---|---|
| 2009/0113945 | A1 * | 5/2009 | Kim et al. | 68/5 |
| 2009/0139037 | A1 | 6/2009 | Jeong et al. | |

FOREIGN PATENT DOCUMENTS

| | | | | |
|---|---|---|---|---|
| DE | 8114533 | U1 | | 9/1981 |
| DE | 3425587 | A1 | * | 1/1986 |
| DE | 3711531 | A1 | * | 10/1987 |
| DE | 3917015 | A1 | * | 11/1990 |
| DE | 4209582 | A1 | * | 9/1993 |
| DE | 3917013 | C2 | | 1/1996 |
| DE | 20314718 | U1 | | 12/2003 |
| DE | 202009004799 | U1 | * | 9/2010 |
| EP | 0094409 | B1 | | 12/1985 |
| EP | 0527297 | A1 | | 2/1993 |
| EP | 0807398 | A2 | | 11/1997 |
| EP | 900965 | A2 | * | 3/1999 |
| EP | 1201981 | A1 | | 5/2002 |
| EP | 0900965 | B1 | | 11/2004 |
| EP | 1674028 | A2 | | 6/2006 |
| EP | 1312849 | B1 | | 5/2007 |
| EP | 1520926 | B1 | | 10/2008 |
| EP | 1798326 | B1 | | 6/2009 |
| GB | 977585 | | | 12/1964 |
| GB | 2161501 | A | * | 1/1986 |
| JP | 4225878 | A | | 8/1992 |
| JP | 2952045 | B2 | | 9/1999 |
| JP | 2002315714 | A | | 10/2002 |
| WO | WO 03014457 | A1 | * | 2/2003 |

OTHER PUBLICATIONS

Machine translation of abstract CN201370559Y, dated Dec. 2009.*
Machine translation of DE 3917015 A1, dated Nov. 1990.*
Machine translation of DE 3711531 A1, dated Oct. 1987.*
Machine translation of DE4209582A1, dated Sep. 1993.*

* cited by examiner

DISHWASHER WITH MOVABLE LIQUID CONDUIT

BACKGROUND OF THE INVENTION

Dishwashers may include one or more compartments for receiving and treating utensils. In drawer-type dishwashers the compartment is in the form of a drawer or pull-out treating chamber slidably mounted in a chassis. A utensil rack and liquid sprayers are provided in each treating chamber to support and apply liquid to the utensils, respectively, during a treating cycle of operation. A liquid system for supplying liquid to the sprayers is provided within the chassis and coupled to the sprayers by extendible conduits to enable the conduit to remain connected to the sprayers as the drawer is slid in and out of the chassis. In most multi-compartment dishwashers, a cycle of operation may be performed in one or both of the treating chambers to wash utensils contained therein.

SUMMARY OF THE INVENTION

According to one embodiment of the invention, a dishwasher comprises a chassis defining an interior with an open face, a first fluid coupling located within the interior, a drawer slidably mounted to the chassis for slidable movement through the open face and at least partially defining a treating chamber with a second fluid coupling and a fluid conduit extending between the first fluid coupling and the second fluid coupling. The fluid conduit comprises a telescoping fluid line having multiple, telescopically connected segments, with a first segment fluidly coupled to the first fluid coupling and a second segment fluidly connected to the second fluid coupling, and a bellows comprising multiple pleats and extending between the first fluid coupling and the second fluid coupling, and encompassing the telescoping fluid line. As the drawer is slid from a wash position, where the treating chamber is located within the interior, to a loading position, where at least a portion of the treating chamber is exterior of the chassis, the fluid conduit moves from a contracted position to an extended position to extend the segments relative to each other and expand the pleats of the bellows.

According to another embodiment of the invention, a dishwasher comprises a chassis defining an interior with an open face, a first fluid coupling located within the interior, a drawer slidably mounted to the chassis for slidable movement through the open face and at least partially defining a treating chamber with a second fluid coupling, a bellows having multiple pleats defining an interior and extending between the first fluid coupling and the second fluid coupling and a wiper provided within the bellows interior. The wiper is arranged relative to the bellows to contact and wipe the pleats as the drawer is slid between a loading position, where at least a portion of the tub is exterior of the chassis, and a wash position where the tub is located within the interior, which moves the bellows between an extended position, where the pleats are generally expanded, and a contracted position, where the pleats are generally compressed.

According to yet another embodiment of the invention, a dishwasher comprises a chassis defining an interior with an open face, a drawer slidably mounted to the chassis for slidable movement through the open face between a wash position and a load position, a tub carried by the drawer and at least partially defining a treating chamber having a tub outlet and a fluid conduit comprising a first portion carried by the chassis, and a second portion carried by the drawer. The first and second portions have cooperating ends that fluidly couple when the drawer is in the wash position and fluidly uncouple when the relative orientation of the second portion to residual liquid at the tub outlet prevents the residual liquid at the tub outlet from flowing out the open end of the second portion as the drawer is moved from the wash to the load position.

DESCRIPTION OF EMBODIMENTS OF THE INVENTION

Figure 1:
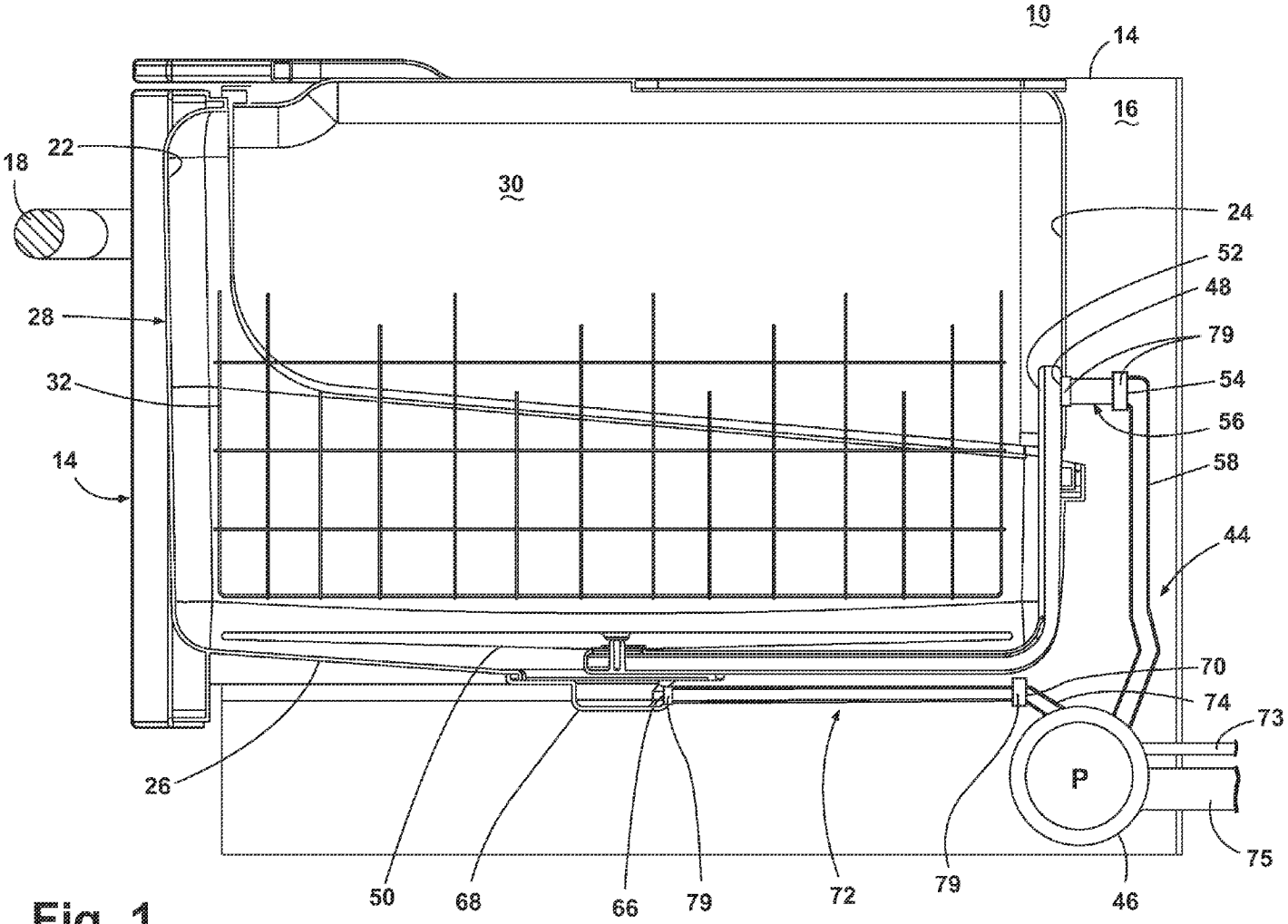
FIG. 1 is a schematic of a cross-sectional view of a dishwasher having a slidable drawer according to a first embodiment of the invention.

FIG. 1 is a schematic of a cross-sectional view of a drawer-type dishwasher 10 having a drawer 12 for receiving utensils for treatment, such as washing. As used in this description, the term "utensil(s)" is intended to be generic to any item, single or plural, that may be treated in the dishwasher 10, including, without limitation: dishes, plates, pots, bowls, pans, glassware, and silverware.

While the embodiments of the invention are described in the context of a dishwasher 10 having a single drawer 12, it is within the scope of the invention for the embodiments of the invention to be used in any suitable type of dishwasher having any number of compartments. For example, in drawer-type dishwashers as illustrated, the compartments may be in the form of multiple drawers.

The dishwasher 10 includes a chassis 14, which may be considered an outer housing, frame, or a combination of both, defining an interior 16. The drawer 12 may be in the form of a slide-out drawer unit having a handle 18 for facilitating movement of the drawer 12 between an open or load position, in which at least a portion of the drawer 12 is exterior of the chassis 14 and utensils may be loaded into the drawer 12 for treatment, and a closed or wash position, in which the drawer 12 is located within the interior 16 and utensils may be treated within the drawer 12 according to a cycle of operation.

The drawer 12 includes a front wall 22, a rear wall 24, a bottom wall 26 and two opposing side walls (not shown) defining a tub 28 that at least partially defines a treating chamber 30. A utensil rack 32 for supporting various objects, such as utensils and the like, to be treated according to a cycle of operation may be provided in the treating chamber 30. The drawer 12 may be slidably mounted to the chassis 14 according to any known mechanism, such as through a pair of extendible support guides (not shown), for example, such that the drawer 12 may carry the tub 28 between the open and closed positions.

The dishwasher 10 also includes a liquid supply and recirculation system 44 that includes a pump system 46 for selectively supplying, recirculating and draining liquid to and from the treating chamber 30. The liquid supply and recirculation system 44 may include a tub inlet 48, which may also be considered an inlet to the treating chamber 30, which is fluidly coupled at a first end with a spray arm assembly 50 through a spray arm conduit 52 provided in the drawer 12 for supplying liquid to the treating chamber 30 during a cycle of operation. The tub inlet 48 may also be fluidly coupled with a pump outlet 54 at a second end through a tub inlet conduit 56. The pump outlet 54 may be fluidly coupled with the pump system 46 through a supply conduit 58 for supplying liquid to the spray arm assembly 50 through the tub inlet conduit 56, the tub inlet 48 and the spray arm conduit 52.

While the spray arm assembly 50 is illustrated as a rotating spray arm, the spray arm assembly 50 may be of any structure and configuration known in the art, non-limiting examples of which include one or more fixed or rotatable spray heads and/or nozzles. It is also within the scope of the invention for the spray arm assembly 50 to be provided at different locations within the treating chamber 30, such as above the utensil rack 32 or on the rear wall 24 of the drawer 12. It is also within the scope of the invention for a combination of spray arm assemblies and/or nozzles to be provided at a multiple locations within the treating chamber 30.

The liquid supply and recirculation system 44 further includes a tub outlet 66 fluidly coupled at a first end with the bottom wall 26 of the drawer 12. The bottom wall 26 may have a low area that defines a sump region 68 in which liquid sprayed into the treating chamber 30 naturally collects in response to gravity. The tub outlet 66 may be coupled with the bottom wall 26 at the sump region 68 to drain liquid collected in the sump region 68. The tub outlet 66 may be fluidly coupled at a second end with a pump inlet 70 through a tub outlet conduit 72. The pump inlet 70 may also be fluidly coupled with the pump system 46 through a pump inlet conduit 74. In this manner, liquid may be drained from the tub 28 through the tub outlet 66, the tub outlet conduit 72, the pump inlet 70 and the pump inlet conduit 74 to the pump system 46.

While the pump outlet 54 is described as being coupled with the pump system 46 through the supply conduit 58, it is also within the scope of the invention for the pump outlet 54 to be directly coupled to the pump system 46. Similarly, while the pump inlet 70 is described as being coupled with the pump system 46 through the pump inlet conduit 74, it is also within the scope of the invention for the pump inlet 70 to be directly coupled to the pump system 46.

The pump system 46 may include any type of suitable pump or combination of pumps for supplying, recirculating and draining liquid to and from the treating chamber 30. For example, the pump system may include a wash pump for selectively supplying liquid to the treating chamber 30. Alternatively or in combination with the wash pump, the pump system 46 may include a recirculation pump in which liquid supplied to the treating chamber 30 may be drained and re-supplied to the treating chamber 30 any number of times. The pump system 46 may also include a drain pump for draining liquid from the treating chamber 30 to an external drain (not shown). The pump system 46 may be configured such that the pump system 46 remains stationary within the interior 16 of the chassis 14 as the drawer 12 is moved between the open and closed positions. It is also within the scope of the invention for all or a portion of the pump system 46 to move with the drawer 12 as the drawer 12 is moved between the open and closed positions. The pump system 46 may also be fluidly coupled with a household water supply through a water supply conduit 73 and a household drain through a household drain conduit 75.

Exemplary pump systems are disclosed in assignee docket number SUB-US20080648-US-CIP, titled "Rotating Drum Filter for Dishwashing Machine", assignee docket number PAT-00015-US-NP, titled "Dishwasher with Shared Heater" and assignee docket number PAT-00020-US-NP, titled "Dishwasher with Unitary Wash Module" and U.S. application Ser. No. 12/643,394, filed Dec. 21, 2009, all of which are incorporated herein by reference in their entirety.

Figure 2:
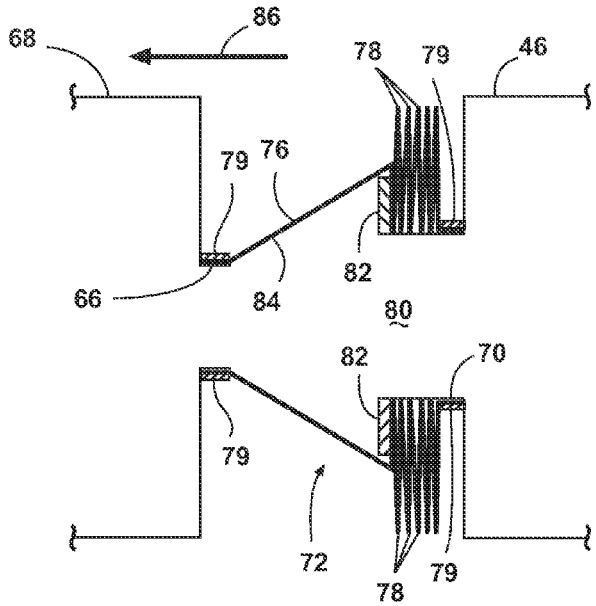
FIG. 2 is a schematic of a fluid coupling in a contracted position for use in the dishwasher of FIG. 1 according to the first embodiment of the invention.

FIG. 2 illustrates in more detail the tub outlet conduit 72 fluidly coupling the tub outlet 66 and the pump inlet 70. The tub outlet conduit 72 may include an extendible bellows 76 having a plurality of pleats 78 extending between the tub outlet 66 and the pump inlet 70. The bellows 76 may define an interior 80 through which liquid flows between the tub outlet 66 and the pump inlet 70.

The tub outlet conduit 72 may be secured at opposite ends to the tub outlet 66 and the pump inlet 70 by a coupler 79. The coupler 79 may be any suitable mechanical and/or non-mechanical fastener. Non-limiting examples of mechanical fasteners include a pipe clamp, a worm gear clamp, a spring clamp and a hose fitting. Non-limiting examples of suitable non-mechanical fasteners include an adhesive and an ultrasonic weld. Alternatively, it is also within the scope of the invention for an end of the tub outlet conduit 72 to be integrally formed with the tub outlet 66 and/or the pump inlet 70.

The tub outlet conduit 72 may also include a wiper 82 extending from one of the tub outlet 66 and/or the pump inlet 70 within the interior 80 of the bellows 76. FIG. 2 illustrates the wiper 82 extending from the pump inlet 70. The wiper 82 may extend outwardly from an outer periphery of the pump inlet 70 such that the wiper 82 does not block the flow of liquid through the tub outlet conduit 72. The wiper 82 may be configured such that an outer periphery of the wiper 82 conforms to an inner periphery of an inner surface 84 of the bellows 76. For example, if the cross section of the bellow is round or square, the wiper 82 may have a corresponding complementary round or square periphery. The wiper 82 can have any desired shape such that the wiper 82 comes into contact with at least a portion of the inner surface 84 of the bellows 76 as the bellows 76 is moved relative to the wiper 82. For example, the wiper 82 may be a blade, plate, brush or combination thereof. The wiper 82 may be in the form of a single plate which extends completely around the periphery of the pump inlet 70, for example. In another example, the wiper 82 may be in the form of a plurality of individual plates spaced around the periphery of the pump inlet 70.

Figure 3:
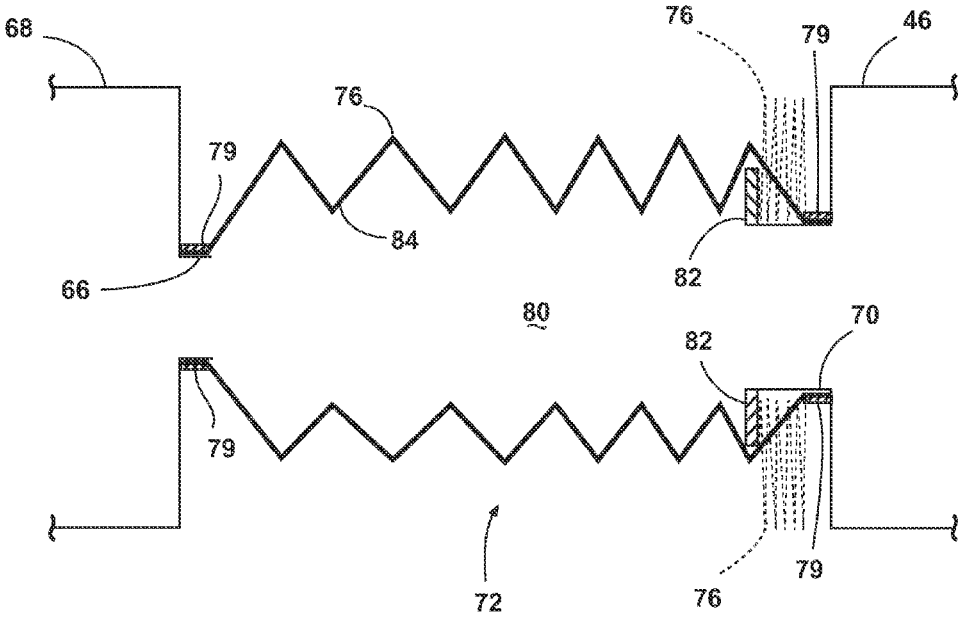
FIG. 3 is a schematic of a fluid coupling in an extended position for use in the dishwasher of FIG. 1 according to the first embodiment of the invention.

As the drawer 12 is moved from a closed position, illustrated in FIG. 2, to an open position, illustrated in FIG. 3, as indicated by arrow 86, the tub outlet conduit 72 moves from a contracted position to an extended position. As the tub outlet conduit 72 moves to the extended position, the bellows 76 is stretched such that the pleats 78 are generally extended and the bellows takes on a flattened configuration. That is, the height of the peaks of the bellows will reduce as the intervening valleys separate. As the wiper is sized such that its periphery extends above the minimum peak height of the pleats, as the bellows 76 is extended from the contracted condition shown in phantom in FIG. 3 to the extended condition shown in a solid line, the inner surface 84 of the bellows 76 will naturally contact the wiper 82. In this manner, the wiper 82 may remove debris which may have accumulated on the inner surface 84 of the bellows 76.

As the drawer 12 is moved from the open position illustrated in FIG. 3 back to the closed position illustrated in FIG. 2, the movement is reversed. As the drawer 12 is moved to the closed position, the tub outlet conduit 72 moves to the contracted position, the bellows 76 contract and the pleats 78 uncompress. As the bellows 76 is contracted, the inner surface 84 of the bellows 76 may come into contact with the wiper 82 again to remove accumulated debris from the inner surface 84. In this manner, the drawer 12 may be moved back and forth between the open and closed position without interrupting the fluid connection between the tub outlet 66 and the pump inlet 70.

The tub outlet conduit 72 and the wiper 82 may be configured such that the wiper 82 may come into contact with the bellows 76 to remove debris from the inner surface 84 when the tub outlet conduit 72 is extended, contracted or during both movements. For example, the wiper 82 may be configured such that the wiper 82 contacts a first side of the pleats 78 as the drawer 12 is moved to the open position and the tub outlet conduit 72 is extended. The wiper 82 may also be configured such that the wiper contacts a second side of the pleats 78, opposite the first side, as the drawer 12 is moved from the open position to the closed position. The wiping is predominately one-directional along the line of travel of the drawer 12. That is, the sides of the pleats facing the wiper 82 for the given direction of travel are wiped. Therefore, an opening and closing of the drawer 12 will effect a cleaning of both sides of a pleat.

While the bellows 76 and wiper 82 have been described in the context of the tub outlet conduit 72, it is also within the scope of the invention for the bellows 76 and wiper 82 to be used in a similar manner with the tub inlet conduit. It is also within the scope of the invention for the bellows 76 and the wiper 82 to be used with any other conduit extending between a stationary component and a movable component of the dishwasher 10. For example, if the pump system 46 moves with the drawer 12, the bellows 76 and the wiper 82 may be used with a conduit coupling the pump system 46 and a water inlet from a household water supply or a drain outlet to a household drain.

Figure 4:
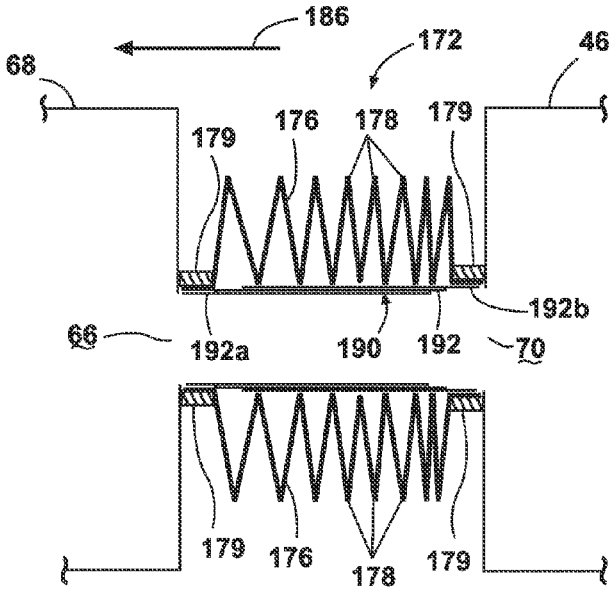
FIG. 4 is a schematic of a fluid coupling in a contracted position for use in the dishwasher of FIG. 1 according to a second embodiment of the invention.

FIG. 4 illustrates a second embodiment of the invention comprising a tub outlet conduit 172, which is similar to the first tub outlet conduit 72, except for a telescoping fluid line 190. Therefore, elements in the tub outlet conduit 172 similar to those of tub outlet conduit 72 will be numbered with the prefix 100.

The tub outlet conduit 172 may fluidly couple the tub outlet 66 and the pump inlet 70. The tub outlet conduit 172 may include a bellows 176 encompassing the telescoping fluid line 190. The telescoping fluid line 190 may include a plurality of multiple, telescopically connected segments 192. A first segment 192*a* may be coupled at a first end with the tub outlet 66 and at a second end with an adjacent segment 192. A second segment 192*b*, at an end opposite the first segment 192, may be coupled at a first end with the pump inlet 70 and at a second end with an adjacent segment 192. While the telescoping fluid line 190 is illustrated as having three segments 192, it will be understood that the telescoping fluid line 190 may have any desired number of segments 192.

The bellows 176 and telescoping fluid line 190 may be secured at opposite ends to the tub outlet 66 and the pump inlet 70 by a coupler 179. Alternatively, a portion of the bellows 176 and/or the telescoping fluid line 190 may be integrally formed with tub outlet 66 and/or the pump inlet 70. For example, the first end of the first segment 192*a* may be integrally molded with the tub outlet 66 and the first end of the second segment 192*b* may be integrally molded with the pump inlet 70.

Figure 5:
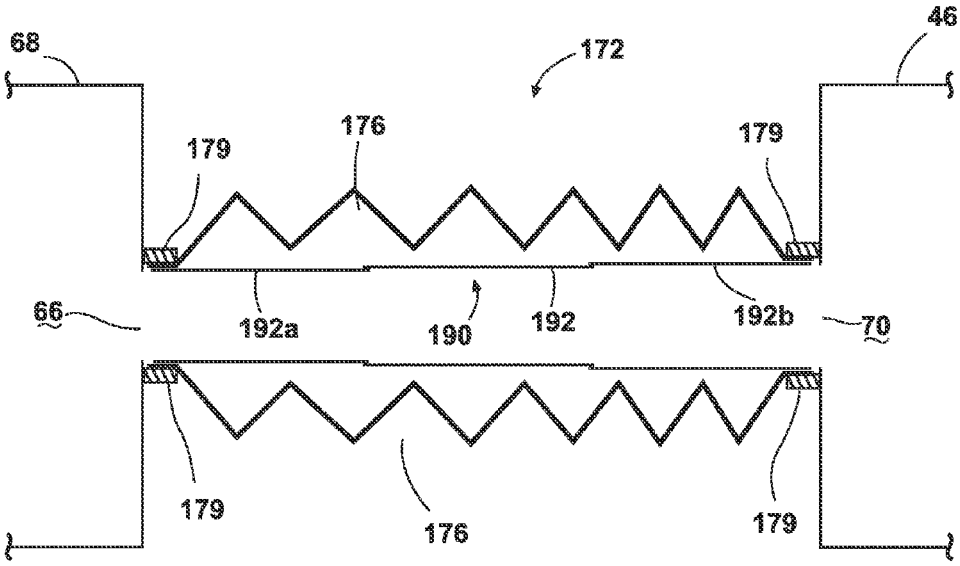
FIG. 5 is a schematic of a fluid coupling in an extended position for use in the dishwasher of FIG. 1 according to the second embodiment of the invention.

As the drawer 12 is moved from a closed position, illustrated in FIG. 4, to an open position, shown in FIG. 5, as illustrated by arrow 186, the tub outlet conduit 172 moves from a contracted position to an extended position. As the tub outlet conduit 172 moves to the extended position, the bellows 176 is stretched to an extended position such that the pleats 178 are generally compressed. In addition, as the tub outlet conduit 172 moves to the extended position, the segments 192 of the telescoping fluid line 190 also extend relative to one another.

As the drawer 12 is moved from the open position illustrated in FIG. 5 back to the closed position illustrated in FIG. 4, the movement is reversed. As the tub outlet conduit 172 moves to the contracted position, the bellows 176 is contracted, the pleats 178 uncompress and the segments 192 of the telescoping fluid line 190 contract relative to one another. In this manner, the drawer 12 may be moved back and forth between the open and closed position without interrupting the fluid connection between the tub outlet 66 and the pump inlet 70. The tub outlet conduit 172 may be configured such that any liquid that leaks from the telescoping fluid line 190 is caught by the bellows 176 and drained to either or both the tub 28 or the pump system 46.

While the bellows 176 and telescoping fluid line 190 have been described in the context of the tub outlet conduit 172, it is also within the scope of the invention for the bellows 176 and telescoping fluid line 190 to be used in a similar manner with the tub inlet conduit 56. It is also within the scope of the invention for the bellows 176 and telescoping fluid line 190 to be used with any other conduit extending between a stationary component and a movable component of the dishwasher 12.

Figure 6:
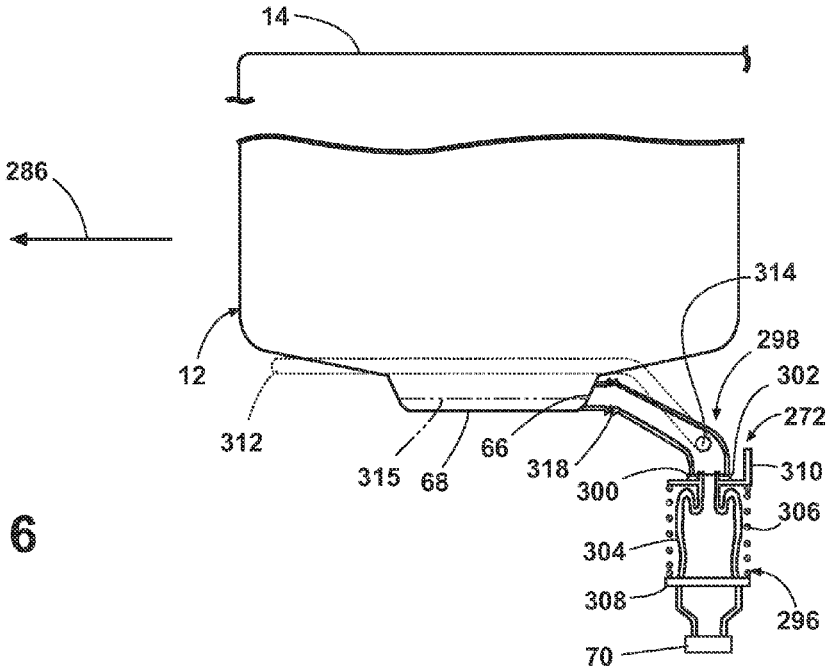
FIG. 6 is a schematic of a fluid coupling in an engaged position according to a third embodiment of the invention.

FIG. 6 illustrates a third embodiment of the invention comprising a tub outlet conduit 272, which is similar to the first tub outlet conduit 72, except for the tub outlet conduit 272 includes a first portion 296 and a second portion 298. Therefore, elements in the tub outlet conduit 272 similar to those of tub outlet conduit 72 will be numbered with the prefix 200.

The tub outlet conduit 272 includes a first portion 296, which is carried by the chassis 14, and a second portion 298, which is carried by the drawer 12 such that the second portion 298 moves with the drawer 12 relative to the chassis 14. The first portion 296 and second portion 298 may be selectively fluidly coupled at a joint 300. The joint 300 may be provided with a seal 302, such as a gasket or o-ring, for example, to provide a liquid tight seal between the first and second portions 296, 298 when the first and second portions 296, 298 are coupled at the joint 300.

The first portion 296 may also include an extendible gasket 304, such as a rolling diaphragm, at an end adjacent to the joint 300. The first portion 296 may also include a biasing element 306, such as a spring for example, encompassing at least a portion of the extendible gasket 304. The biasing element 306 may extend between a first support member 308 and a second support member 310, which is adjacent the joint 300 and abuts the seal 302.

The chassis 14 may also include a track 312, which remains stationary with respect to the chassis 14. The second portion 298 may be provided with a cam follower 314 which engages the track 312 and moves along a path defined by the track 312. The first portion 296 may also be provided with a cam follower (not shown), which engages the track 312 and moves along at least a portion of the path defined by the track 312.

Figure 7:
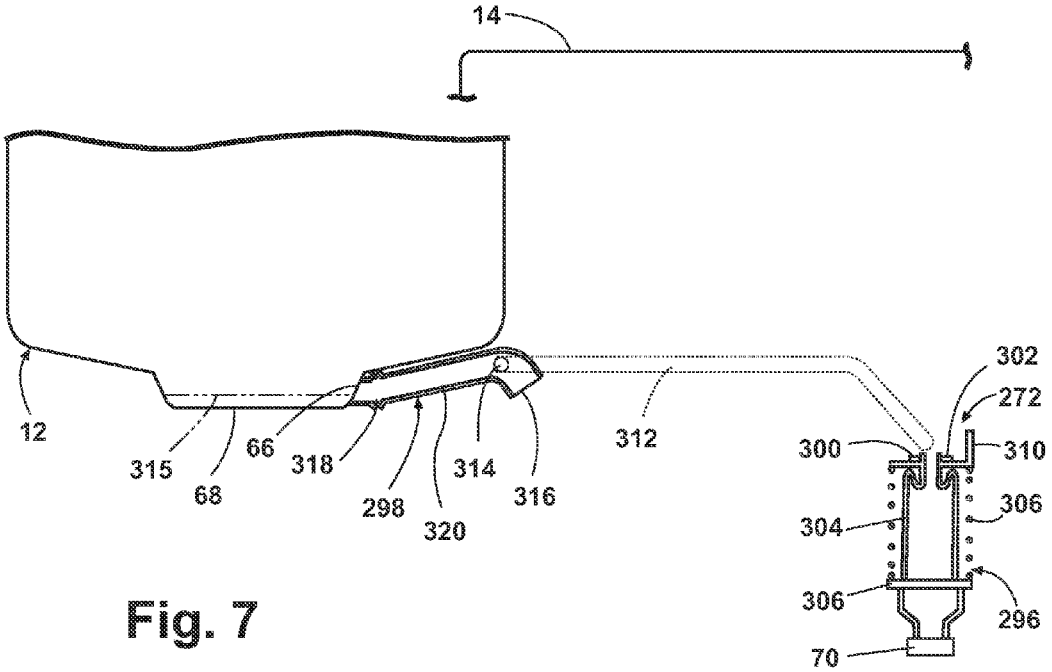
FIG. 7 is a schematic of a fluid coupling in a disengaged position according to the third embodiment of the invention.

As the drawer 12 is moved from a closed position, illustrated in FIG. 6, to an open position, illustrated in FIG. 7, as indicated by arrow 286, the tub outlet conduit 272 also moves in a manner that provides for the separation of the first and second portions 296, 298, without spilling of the liquid in the sump region 68. Initially, as the drawer 12 is moved from the closed position, the first portion 296 and second portion 298 remain fluidly coupled at the joint 300 by the upward movement of the first portion 296 while the second portion 298 moves along the track 312 by way of the cam followers. The force of the biasing element 306 effects the upward movement of the first portion 296 as permitted by the extendible gasket 304 to keep the seal 302 of the joint 300 in sealing engagement with the open end 316 of the second portion 298. In this way, the upward extension of the first portion 296 compensates for the initial upward and lateral movement of the second portion 298 along the track 312.

At some point during the opening of the drawer 12, the upward movement of the second portion 298 will be great enough that the first portion 296 can no longer accommodate the motion and the seal 302 will unseat from the open end 316. For convenience, the track 312 may be configured such that the unseating occurs at the transition from the angled portion to the horizontal portion, but it is not required.

Figure 8:
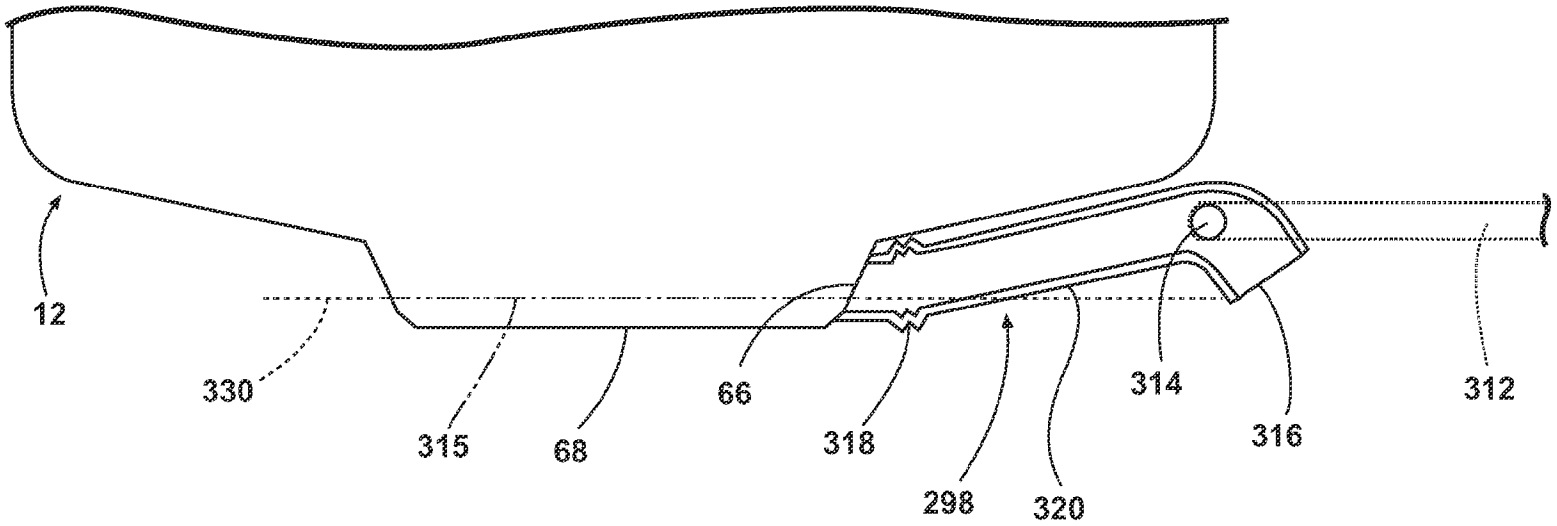
FIG. 8 is an enlarged view of the fluid coupling of FIG. 7 according to the third embodiment of the invention.

As illustrated in FIG. 8, wherever the unseating occurs, the second portion 298 and track 312 may be configured such that this unseating occurs when the open end 316 lies above the residual liquid 315, as highlighted by reference line 330. Alternatively, the track 312 may be configured such that the first and second portions 296, 298 do not separate at the joint 300 until a segment of a lower surface 320 of the second portion 298 lies above the residual liquid 315 at the tub outlet 66. In this manner, residual liquid 315 in the tub outlet 66 may be prevented from flowing or spilling out the open end 316. It will be understood that there may be some nominal spilling or dripping from the open end 316 as a result of liquid that may remain in the second portion 298 near the open end 316 prior to separation of the first and second portions 296, 298 or as a result of splashing of the residual liquid 315 during movement of the drawer 12.

After the seal 302 is unseated, the continued movement of the drawer 12 to the open position will not result in the residual liquid spilling through the open end 316 and the drawer 12 can be opened without concern of spilling.

The track 312 may be configured such that the track 312 is provided with a vertical stop that prevents further vertical movement of the first portion 296 and results in separation of the first and second portions 296, 298 at the joint 300. The vertical stop may be provided at a position along the track 312 such that the first and second portions 296, 298 separate at the joint 300 when a relative orientation of the second portion 298 prevents residual liquid 315 at the tub outlet 66 from flowing out an open end 316 of the second portion 298.

The second portion 298 may be provided with a flexible section 318, such as a bellows, such that the second portion 298 may continue to follow the track 312 as the drawer 12 is moved to the open position. Alternatively, the second portion 298 may be connected with the tub outlet 66 by a flexible or pivotal coupler such that the second portion 298 may continue to follow the track 312.

When the drawer 12 is moved from the open position in FIG. 7 back to the closed position in FIG. 6, the second portion 298 moves in the reverse direction along the track 312 until it re-engages the first portion 296 at the joint 300. Further movement of the drawer 12 towards the closed position may compress the seal 302 at the joint 300 and also compress the biasing element 306 against its upward bias, further compressing the seal 302. In this manner, the seal 302, extendible gasket 304, biasing element 306 and first and second support members 308, 310 provide an extendible and compressible coupling for connecting the first and second portions 296, 298 at the joint 300.

While the track 312 has been described as being mounted to the chassis 14 and the second portion 298 has a cam follower mounted to the track 312, it is also within the scope of the invention for the track 312 to be mounted to the second portion 298 and the chassis 14 includes the cam follower.

The embodiments of the invention described herein provide liquid conduits for use with dishwashers having at least one drawer which is slidingly moved between open and closed positions. The embodiments described above provide for liquid conduits that are short, eliminating the need for long conduits that may become tangled or kink and inhibit the flow of liquid through the liquid conduit. The first and second embodiments described above provide for liquid conduits that are not only short, but also remain open and connected as the drawer is moved between the open and closed positions, which may decrease the risk of leaks compared to conduits which uncouple as the drawer is moved. The third embodiment reduces the risk of leaks by preventing the uncoupling of the liquid conduit until the residual liquid in the tub is unable to flow out the open end.

In addition, the use of a wiper for removing debris from the inner surface of the bellows as the drawer is moved between the open and closed positions, may decrease the risk of clogs forming within the liquid conduit which can decrease the flow of liquid and potentially lead to leaks. The combination of a bellows encompassing a telescoping conduit can also decrease the risk of leaks. The bellows can be provided around the telescoping conduit to catch any liquid that may leak from the telescoping conduit.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dishwasher comprising:

a chassis defining an interior with an open face;

a first fluid coupling located within the interior;

a drawer slidably mounted to the chassis for slidable movement through the open face and at least partially defining a treating chamber with a second fluid coupling; and a fluid conduit extending between the first fluid coupling and the second fluid coupling, comprising:

a telescoping fluid line having multiple, telescopically connected segments, with a first segment fluidly coupled to the first fluid coupling and a second segment fluidly connected to the second fluid coupling; and a bellows comprising multiple pleats and extending between the first fluid coupling and the second fluid coupling, encompassing the telescoping fluid line, and configured to direct liquid escaping from the telescoping fluid line into a space between the telescoping fluid line and the bellows and the bellows is configured such that the escaped liquid is drainable through the first fluid coupling and the second fluid coupling; and wherein as the drawer is slid from a wash position, where the treating chamber is located within the interior, to a loading position, where at least a portion of the treating chamber is exterior of the chassis, the fluid conduit moves from a contracted position to an extended position to extend the segments relative to each other and expand the pleats of the bellows.

2. The dishwasher of claim 1 wherein the first fluid coupling comprises one of a water inlet from a household water supply, a pump outlet, a drain outlet to a household drain, or a pump inlet.

3. The dishwasher of claim 2 further comprising one of a recirculation pump or a wash pump, with the pump inlet being provided on the one of the recirculation pump or the wash pump.

4. The dishwasher of claim 3 wherein at least one of the recirculation pump or the wash pump does not move with the drawer as the drawer is slid from the wash position to the load position.

5. The dishwasher of claim 2 wherein the second fluid coupling comprises one of a treating chamber inlet or a treating chamber outlet.

6. The dishwasher of claim 5 wherein the treating chamber inlet is coupled with a sprayer mounted within the treating chamber.

7. The dishwasher of claim 5 wherein the treating chamber outlet comprises a drain outlet in the treating chamber.

8. The dishwasher of claim 1 wherein the first and second fluid couplings receive the corresponding segment.

9. The dishwasher of claim 8 wherein the bellows circumscribes the first and second fluid couplings.

10. The dishwasher of claim 9 further comprising at least one clamp compressing the bellows about at least one of the first and second fluid couplings.

11. The dishwasher of claim 1 wherein the drawer further comprises a tub and the tub at least partially defines the treating chamber.

12. A dishwasher comprising:

a chassis defining an interior with an open face;

a first fluid coupling located within the interior;

a drawer having a bottom wall and slidably mounted to the chassis for slidable movement through the open face and at least partially defining a treating chamber;

a tub outlet fluidly coupled with the bottom wall of the drawer;

a pump system having a pump outlet fluidly coupled to an inlet of the treating chamber and having a pump inlet fluidly coupled to the tub outlet; and a fluid conduit extending between the tub outlet and the pump inlet, comprising:

a telescoping fluid line having multiple, telescopically connected segments, with a first segment fluidly coupled to the tub outlet and a second segment fluidly connected to the pump inlet; and a bellows comprising multiple pleats and extending between the tub outlet and the pump inlet, encompassing the telescoping fluid line, and configured to direct liquid escaping from the telescoping fluid line into a space between the telescoping fluid line and the bellows and the bellows is configured such that the escaped liquid is drainable through the tub outlet and the pump inlet; and wherein as the drawer is slid from a wash position, where the treating chamber is located within the interior, to a loading position, where at least a portion of the treating chamber is exterior of the chassis, the fluid conduit moves from a contracted position to an extended position to extend the segments relative to each other and expand the pleats of the bellows.

* * * * *